United States Patent [19]

Kemme

[11] Patent Number: 4,504,576

[45] Date of Patent: Mar. 12, 1985

[54] PHOTOGRAPHIC SUPPORT PAPER HAVING A SURFACE SIZE

[75] Inventor: Gregor Kemme, Osnabrück, Fed. Rep. of Germany

[73] Assignee: Felix Schoeller Jr. GmbH & Co., KG, Osnabrück, Fed. Rep. of Germany

[21] Appl. No.: 466,584

[22] Filed: Feb. 15, 1983

[51] Int. Cl.[3] ..... G03C 1/78

[52] U.S. Cl. ..... 430/538; 162/158

[58] Field of Search ..... 430/538; 162/158

[56] References Cited

U.S. PATENT DOCUMENTS

| | | | |
|---|---|---|---|
| 3,139,373 | 6/1964 | Liggett | 162/158 |
| 3,296,065 | 1/1967 | O'Brien | 162/158 |
| 3,326,744 | 6/1967 | Yungkurth | 162/158 |
| 3,332,834 | 7/1967 | Reynolds | 162/164 |
| 3,821,069 | 6/1974 | Wurzburg | 162/158 |
| 4,288,287 | 9/1981 | Miyama et al. | 162/158 |
| 4,302,283 | 11/1981 | Blitzer et al. | 162/158 |
| 4,317,756 | 3/1982 | Dumas | 162/158 |
| 4,331,508 | 5/1982 | Miyama et al. | 430/538 |
| 4,353,981 | 10/1982 | Noda et al. | 430/538 |
| 4,410,619 | 10/1983 | Kubbota et al. | 430/538 |

OTHER PUBLICATIONS

Internal Sizing of Paper and Paperboard, Tappi Monograph Series, No. 53, 1973, pp. 1–4.

The Condensed Chemical Dictionary, Eighth Edition, (1982), pp. 12, 41 and 704.

*Primary Examiner*—Jack P. Brammer

*Attorney, Agent, or Firm*—Lockwood, Alex, FitzGibbon & Cummings

[57] ABSTRACT

Photographic support paper for photographic coatings containing silver salt, which possesses a neutral internal size and contains a cationic setting agent, the paper support being treated with at least one organic acid which either is a multivalent acid, the acid groups of which are separated from one another by at most three carbon atoms, and/or is a hydroxy acid capable of internal complex formation.

12 Claims, No Drawings

PHOTOGRAPHIC SUPPORT PAPER HAVING A SURFACE SIZE

BACKGROUND OF INVENTION

This invention relates to an improved support paper for photographic coatings containing a silver salt or salts.

There are known support papers for photographic coatings which are internally sized in the conventional manner with resin soaps, fatty acid soaps or fatty acid anhydrides, and as the sizing agent is precipitated with acid substances, for example aluminium sulphate, aluminium chloride, formic acid or the like, they are classified as so-called acid papers. Such papers have been used for decades either directly or, after coating with pigmented and/or water-repelling coatings, as supports for photographic coatings. The photographic coatings can be either those for black-and-white or those for colour photography.

For some years, furthermore, photographic paper supports have been known, which contain a neutral internal sizing. This so-called "neutral sizing" is based preferably upon the use of a dispersion of an alkyl ketene dimer, which is precipitated by means of a cationic substance, such as a polyamine and/or polyamide resin, onto the cellulose fibres and renders these hydrophobic. This type of internal sizing of paper is described, for example, in W. German Patent Application No. 2 710 061. Such neutrally sized papers are coated, like the conventional acid papers, for example with synthetic resins and are utilized in this form as supports for photographic coatings. This is described in W. German Patent Application No. 2 641 266.

Photographic papers not only have to be sized but must also be moisture resistant. Otherwise, they could lose strength and cohesiveness in photographic process solutions. Papers which are coated to render them waterproof on the surface, but are not internally water-resistant, split after treatment in photographic baths at their cut edges, sometimes by several mm. It is therefore essential, in addition to the sizing, to render them internally waterproof.

In the case of acid sized papers, for achieving the necessary internal waterproofness, condensed formaldehyde-releasing resins are used. Such resins are preferably melamine formaldehyde or urea formaldehyde resins in precondensed form. Optimum waterproofness of this photographic paper is achieved, with these resins, only with an acid pH of 5 or less than 5.

A disadvantage of the conventional acid papers which are rendered waterproof with resins containing formaldehyde, is that when stored, formaldehyde is released from formaldehyde-containing substances. Released formaldehyde influences the photographic coatings. The state of hardening of the coatings is modified, the tone of black-and-white pictures undergoes changes, and due to the reaction with the couplers in colour photographic coatings, undesired changes in colour are produced.

A disadvantage of acid-sized papers is, moreover, the low pH value of these papers. The sensitivity of photographic silver salt coatings decreases with decreasing pH, whereas photography in general aims at an increase in sensitivity. Finally, a further disadvantage is the low resistance of the acid sizing to modern alkaline developer solutions containing an organic solvent, e.g. benzyl alcohol. Consequently, the neutrally sized papers have come increasingly into favour. Neutrally sized papers require different waterproofing agents. Suitable waterproofing agents, which have become readily available since the end of the nineteen-sixties, are those which contain epoxy groups. In particular, polyamide or polyamine epichlorhydrin resins have proven effective as waterproofing agents in the neutral to slightly alkaline pH range.

Photographic papers neutrally waterproofed in this manner are, however, subject to defects which limit their serviceability. A major disadvantage of the waterproofed neutrally sized papers lies in the fact that all waterproofing agents manufactured from condensation products of epichlorhydrin with polyamines, polyimines and/or polyamides produce haze or ghosting in the photographic coatings which rest on the paper. This haze, even in papers which contain only 0.3 to 2% by wt. of such waterproofing agents, is still measurable in photographic coatings in contact therewith. Also, synthetic resin coatings situated between the paper and the photographic coating only temporarily protect the coating against the effect of these paper constituents which produce haze. In particular, highly sensitive black-and-white emulsions and coatings for diffusion transfer processes are affected by this haze.

SUMMARY OF INVENTION

An object of the present invention is to provide a neutrally sized, waterproof photographic support paper, which does not cause any increased haze in photographic coatings resting thereon. "Increased haze" means haze greater than is obtained with an acid, resin-sized reference paper, rendered waterproof with melamine/formaldehyde resin after four days incubation at 56° C.

According to one aspect of the invention there is provided a photographic support paper for photographic coatings containing a silver salt, the support containing a neutral internal size and a cationic setting agent, wherein the paper has been treated with at least one organic acid selected from polybasic acids, the acid groups of which are separated from one another by not more than 3 carbon atoms and hydroxy acids capable of internal complex formation.

The organic acid may be used in the form of the free acid or as the ammonium salt or acid amide thereof.

In a preferred embodiment of the invention, the organic acid or acid amide or ammonium salt of the acid is applied onto the paper as a constituent of the usual surface sizing solution or dispersion, after the neutrally sized, waterproof paper sheet has been formed and set. The organic acid and/or its derivative may be added to the solution or dispersion used for surface sizing, which solution can contain any binding agent, for example starch, gelatin, a synthetic resin dispersion, an aqueous synthetic resin solution or mixtures of various binding agents, and also other additives of various types.

Possible other additives include pigments, optical brighteners, wetting agents, inorganic salts, plasticizers, agents for increasing water repellancy, foam suppressing agents or other substances, which may be used as required in the solution or dispersion for surface sizing.

The application of the aqueous solution or dispersion onto the paper may be carried out in conventional sizing tubs, sizing presses, coating presses or by means of any other coating or impregnating devices, which are suitable for one-sided or two-sided surface treatment or impregnating of paper.

In the case of a baryted photographic paper, the solution for the surface sizing may consist, for example, of an aqueous solution of gelatin, optionally with addition of glycerine and optical brightener, to which the organic acid, e.g. citric acid and/or its derivative is added.

In the case of a photographic support paper coated with polyolefin, the solution for the surface sizing of the base paper may consist, for example, of an aqueous solution containing starch ether, sodium chloride and an ionomeric resin dispersion, to which the organic acid is added, preferably as its ammonium salt or acid amide, for example ammonium citrate and/or polyacrylic acid amide.

For use as haze-reducing substances in so-called "neutrally sized" waterproof photographic papers, the following free acids and also their amides and ammonium salts are suitable:

Oxalic acid
Lactic acid
Citric acid
Aconitic acid
Tartaric acid
Pyrotartaric acid
Malic acid
Gluconic acid
Succinic acid
Alkyl succinic acids
Glutaric acid
Glutaconic acid
Oxymalonic acid
Sulphoacetic acid
Glutamic acid
Aspartic acid
Maleic acid
Maleic acid copolymers with other monomers, e.g. styrene
Itaconic acid and copolymers thereof
Citraconic acid and copolymers thereof
Polyacrylic acid
Polymethacrylic acid
Polyvinyl sulphonic acid
Polyvinyl phosphoric acid
Benzene disulphonic acid
Sulphuric acid esters of carbohydrates This list is not limiting and all organic acids capable of forming internal complexes and their derivatives and also multibasic organic acids, in which an acid group is separated from the next acid group by not more than 3 carbon atoms, can fulfil the objective of this invention, provided that they are stable at the temperatures usual in the production of paper.

The reason for the action of additives according to this invention is not clear. Since, however, simple monocarboxylic acids, such as formic acid, acetic acid or butyric acid, are even less effective in reducing haze than, for example, benzene sulphonic acid, adipic acid or even phosphoric acid, which have been investigated for comparison, it is assumed that the organic acids which reduce haze are capable of forming stable ring systems with those compounds which appear to be photochemically disturbing, and in this way neutralize them.

DESCRIPTION OF PARTICULAR EMBODIMENTS

The action of the haze-reducing additives according to this invention will be illustrated by the following nonlimiting examples.

EXAMPLE 1

With an endless wire paper making machine, a paper is manufactured in known manner from wood pulp, which paper is sized with 0.3% by wt. relative to the fibrous material of alkyl ketene dimer, and is rendered waterproof with 1.5% by wt. polyamino amide epichlorhydrin resin. The paper is then treated on both sides by means of a sizing press with an aqueous solution having the following composition:

6% by wt. oxidized starch
2% by wt. sodium chloride
0.2% by wt. optical brightener
5% by wt. organic acid or ammonium salt of the acid
86.8% by wt. water.

The organic acid in this solution is one of the following:

(a) Citric acid
(b) Tartaric acid
(c) Mucic acid
(d) Glutaconic acid
(e) Malic acid
(f) Maleic acid
(g) Oxalic acid
(h) Succinic acid
(i) Glycollic acid
(j) Lactic acid
(k) Aspartic acid
(l) $NH_4$ salt of citric acid
(m) $NH_4$ salt of tartaric acid
(n) $NH_4$ salt of oxymalonic acid
(o) $NH_4$ salt of malic acid
(p) $NH_4$ salt of succinic acid
(q) Glutamine
(r) Succinic amide acid
(s) m-Benzene disulphonic acid amide
(t) Ascorbic acid.

The papers surface sized in this manner are dried, smoothed and tested.

EXAMPLE 2

A neutrally sized paper rendered waterproof with polyaminoamide-epichlorhydrin resin, manufactured as in Example 1 by means of an endless wire papermaking machine, is treated by means of a sizing press with an aqueous solution, which contains 4% by wt. of a multivalent polymeric organic acid with film-forming properties.

The organic acid is:

(a) Polyacrylic acid
(b) Polyitaconic acid
(c) Polymaleic acid
(d) Polyvinyl sulphonic acid
(e) Polyvinyl phosphoric acid
(f) $NH_4$ salt of polyacrylic acid
(g) $NH_4$ salt of a maleic acid/methylvinyl ether copolymer
(h) $NH_4$ salt of an acrylic acid/acrylic amide copolymer
(i) $NH_4$ salt of polygalacturonic acid
(k) $NH_4$ salt of polyvinyl alcohol sulphuric acid ester (l) $NH_4$ salt of polyvinyl alcohol phosphoric acid ester
(m) $NH_4$ salt of maleic acid/styrene sulphonic acid copolymer
(n) Polyacrylic acid amide
(o) Polymethacrylic amide The surface sized or impregnated papers are dried, smoothed and tested.

EXAMPLE 3

Neutrally sized and waterproofed paper manufactured as in Example 1 is treated by means of a sizing press with an aqueous solution which contains:

(a)
2% by wt. Gelatine
3% by wt. Ammonium polyacrylate
0.1% by wt. Optical brightener, or (b)
2% by wt. Gelatine
2% by wt. Ammonium cellulose sulphate
0.1% by wt. Optical brightener, or (c)
2% by wt. Gelatine
2% by wt. Ammonium polyvinyl sulphonate
0.1% by wt. Optical brightener, or (d)
3% by wt. Gelatine
3% by wt. Ammonium glutaconate
0.1% by wt. Optical brigtener.

The pH value of the solutions is set to approximately 7 by addition of ammonia.

The surface sized papers are dried, smoothed and tested.

EXAMPLE 4

A paper neutrally sized and waterproofed as in Example 1 is treated by means of a sizing press with an aqueous solution which contains:

3% by wt. Ammonium starch phosphate
1% by wt. Ammonium citrate
4% by wt. Ionomeric resin (used as 50% dispersion)
0.05% by wt. Optical brightener.

The surface sized paper is dried, smoothed and tested.

Reference examples

A paper neutrally sized and waterproofed as in Example 1 is treated by means of a sizing press with an aqueous solution which contains:

(A)
6% by wt. Oxidized starch
2% by wt. Sodium chloride
0.2% by wt. Optical brightener (B)
4% by wt. Enzymatically broken down starch
3% by wt. Ionomeric resin (C)
5% by wt. Oxidized starch
3% by wt. Sodium sulphate
2% by wt. Adipic acid
3% by wt. Acetic acid (D)
3% by wt. Gelatin
3% by wt. Ammonium phosphate.

The surface sized reference papers are dried, smoothed and tested in the same manner as the papers of the foregoing Examples 1–4.

Testing of the photographic properties of the papers

The support papers of the examples and reference examples were first subjected to a photographic testing, in which, after smoothing and drying of the sizing press strokes, they were coated with a conventional black-and-white silver halide emulsion coating and, after incubation, were subjected to a first testing for haze.

In detail, in this testing of the base papers, the procedure was that samples of all the papers were coated with a non-stabilized silver bromide emulsion for the purpose of rapid differentiation. The papers thus rendered sensitive to light were then packed in a light-tight manner, incubated for 3 or 4 days respectively at 56° C., and developed in the standard manner and the haze occurring on each was surveyed with a densitometer. The readings thus obtained are listed in Table 1. From many years of comparative tests, it is known that the results obtained under the stated incubation conditions after 4 days correspond approximately to the results which would be obtained after more than one year of normal storage.

TABLE 1

Measured values of haze on basic papers after 3 and 4 days incubation at 56° C.

| Example No. | Haze value after 3 days | Haze value after 4 days |
|---|---|---|
| 1a | 0.04 | 0.08 |
| 1b | 0.03 | 0.07 |
| 1c | 0.03 | 0.07 |
| 1d | 0.03 | 0.06 |
| 1e | 0.04 | 0.08 |
| 1f | 0.07 | 0.15 |
| 1g | 0.04 | 0.08 |
| 1h | 0.10 | 0.20 |
| 1i | 0.05 | 0.10 |
| 1j | 0.06 | 0.12 |
| 1k | 0.05 | 0.10 |
| 1l | 0.04 | 0.08 |
| 1m | 0.03 | 0.07 |
| 1n | 0.08 | 0.16 |
| 1o | 0.04 | 0.08 |
| 1p | 0.10 | 0.20 |
| 1q | 0.06 | 0.13 |
| 1r | 0.10 | 0.21 |
| 1s | 0.09 | 0.19 |
| 1t | 0.05 | 0.11 |
| 2a | 0.05 | 0.10 |
| 2b | 0.06 | 0.12 |
| 2c | 0.07 | 0.15 |
| 2d | 0.07 | 0.15 |
| 2e | 0.08 | 0.16 |
| 2f | 0.04 | 0.09 |
| 2g | 0.05 | 0.11 |
| 2h | 0.04 | 0.08 |
| 2i | 0.06 | 0.13 |
| 2k | 0.09 | 0.18 |
| 2l | 0.09 | 0.19 |
| 2m | 0.07 | 0.14 |
| 2n | 0.05 | 0.10 |
| 2o | 0.05 | 0.11 |
| 3a | 0.06 | 0.12 |
| 3b | 0.07 | 0.14 |
| 3c | 0.07 | 0.15 |
| 3d | 0.05 | 0.10 |
| 4 | 0.04 | 0.07 |
| A | 0.17 | 0.35 |
| B | 0.16 | 0.34 |
| C | 0.15 | 0.32 |
| D | 0.15 | 0.30 |

In further tests, the basic papers were first further processed to make finished photographic supports.

In detail, the papers of examples 3a-d and also the reference paper D were coated in conventional manner firstly with a gelatine/barytes coating, then coated with a conventional silver halide emulsion and thereafter stored for one year in darkness at room temperature.

The papers of examples 1a-s, 2a-o, 4 and also reference papers A, B and C were coated on both sides with polyethylene according to DAS No. 1 447 815, example 4. The pigmented polyethylene coating was then prepared by means of corona treatment for receiving the light-sensitive coating and thereafter likewise coated with a photographic coating based upon silver halide. The photographic materials having a polyethylene-coated substrate thus produced were stored for two years in darkness at 25° C.

After the end of the storage testing of the baryted and polyethylene-coated materials, the test sheets were developed and the haze occurring in each case measured with a densitometer. The readings obtained are listed in Table 2.

TABLE 2

Measured values of haze on baryted and polyethylene-coated photographic papers after storage testing

| Example No. | Haze value after 1 year | Haze value after 2 years |
|---|---|---|
| 1a | | 0.10 |
| 1b | | 0.08 |
| 1c | | 0.10 |
| 1d | | 0.09 |
| 1e | | 0.10 |
| 1f | | 0.16 |
| 1g | | 0.12 |
| 1h | | 0.18 |
| 1i | | 0.12 |
| 1j | | 0.12 |
| 1k | | 0.12 |
| 1l | | 0.08 |
| 1m | | 0.08 |
| 1n | | 0.12 |
| 1o | | 0.12 |
| 1p | | 0.18 |
| 1q | | 0.16 |
| 1r | | 0.18 |
| 1s | | 0.18 |
| 1t | | 0.10 |
| 2a | | 0.08 |
| 2b | | 0.10 |
| 2c | | 0.08 |
| 2d | | 0.13 |
| 2e | | 0.13 |
| 2f | | 0.10 |
| 2g | | 0.12 |
| 2h | | 0.10 |
| 2i | | 0.13 |
| 2k | | 0.14 |
| 2l | | 0.14 |
| 2m | | 0.10 |
| 2n | | 0.12 |
| 2o | | 0.10 |
| 3a | 0.10 | |
| 3b | 0.12 | |
| 3c | 0.12 | |
| 3d | 0.08 | |
| 4 | — | 0.10 |
| A | — | 0.38 |
| B | — | 0.30 |
| C | — | 0.30 |
| D | 0.28 | — |

A comparison between the haze values of the examples and the haze values of the reference examples shows that an after-treatment according to this invention of the photographic papers waterproofed with epoxidized polyaminoamide resins quite decisively reduces the haze caused by the polyaminoamide resin. Conventional acid-sized papers rendered waterproof with melamine formaldehyde resin have haze values of 0.06 to 0.08 in the same test.

Further series of tests have shown that analogous results are obtained, if as the waterproofing agent for the paper, other cationically acting polyamino or polyimino resins are used than the polyaminoamide epichlorhydrin resin used in examples 1 to 4.

Consequently, it can generally be stated that improved photographic basic papers are furnished with setting agents containing amino or imino groups and carry a surface sizing, which contains chelate-forming organic hydroxy acids and/or multibasic organic acids, the acid groups of which are separated from one another by not more than 3 carbon atoms. The acids according to this invention are preferably present as free acids, as ammonium salts or as acid amides. They may, however, also be present in the form of a lactone.

What is claimed is:

1. In a photographic support paper for a photographic coating containing silver salt, the support paper containing a neutral internal size and a cationic setting agent which result in the presence of photochemically disturbing compounds which cause haze in the photographic coating when deposited on the internally sized paper, the improvement wherein said internally sized paper with setting agent includes a surface size on said internally sized paper of a dried aqueous solution of at least one organic acid, organic salt or organic acid amide which is present in an amount sufficient to substantially reduce the haze which said photochemically disturbing compounds would otherwise produce in the photographic coating, said organic acid, salt or acid amide being selected from the group consisting of (A) polybasic acids, polybasic acid salts or polybasic acid amides, the acid, salt or acid amide groups of which are separated from one another by not more than 3 carbon atoms, and (B) hydroxy acids, hydroxy acid salts or hydroxy acid amides which are capable of forming chelates.

2. Photographic support paper according to claim 1, wherein the organic acid, salt or acid amide has been applied to the support paper in the form of at least one of the free acid, an ammonium salt or amide thereof.

3. Photographic support paper according to claim 1, in which the aqueous solution of the organic acid, salt or acid amide additionally contains at least one further additive selected from the group consisting of pigments, optical brighteners and wetting agents.

4. Photographic support paper according to claim 1, wherein the aqueous solution of the organic acid has been applied by coating or impregnation thereon on one or both sides of the paper.

5. Photographic support paper according to claim 1, wherein the paper contains barytes and the aqueous solution comprises an aqueous solution of gelatin.

6. Photographic support paper according to claim 1 wherein the support is coated with a polyolefin coating and the solution is an aqueous solution containing a starch ether, sodium chloride, a dispersed ionomeric resin and the organic acid, salt or acid amide in the form of the ammonium salt or the acid amide of an organic acid.

7. Photographic support paper according to claim 1, wherein the organic acid, salt or acid amide is selected from the group consisting of an acid, salt or acid amide of oxalic acid, lactic acid, citric acid, aconitic acid, tartaric acid, pyrotartaric acid, malic acid, gluconic acid, succinic acid, alkyl succinic acids, glutaric acid, oxymalonic acid, sulphoacetic acid, glutamic acid, aspartic acid, maleic acid, copolymers of maleic acid with other monomers which may be styrene, itaconic acid and copolymers, citraconic acid and copolymers thereof, polyacrylic acid, polymethacrylic acid, polyvinylsulphonic acid, polyvinylphosphoric acid, benzenedisulphonic acid, sulphuric acid esters of carbohydrates, or mixtures thereof.

8. Photographic support paper according to claim 1, wherein the aqueous solution includes:

6% by wt. oxidized starch,

2% by wt. sodium chloride, 0.2% by wt. optical brightener,

5% by wt. organic acid or ammonium salt of the acid, and 86.8% by wt. water.

9. Photographic support paper according to claim 1, wherein the aqueous solution for treating the photographic support has at least one of the following compositions:

(a) 2% by wt. gelatine 3% by wt. ammonium polyacrylate 0.1% by wt. optical brightener, or (b) 2% by wt. gelatine 2% by wt. ammonium cellulose sulphate 0.1% by wt. optical brightener, or (c) 2% by wt. gelatine 2% by wt. ammonium polyvinyl sulphonate 0.1% by wt. optical brightener, or (d) 3% by wt. gelatine 3% by wt. ammonium glutaconate 0.1% by wt. optical brightener with the remainder of said compositions being water, the pH of the solution being adjusted by means of ammonia to approximately 7.

10. Photographic paper support according to claim 1, wherein the organic acid, salt or acid amide has been applied to the support paper in the form of a lactone of an organic acid.

11. Photographic support paper according to claim 5, wherein said aqueous solution also includes at least one of glycerine and an optical brightener.

12. Photographic support paper according to claim 6, wherein said organic acid, salt or acid amide comprises ammonium citrate or polyacrylic acid amide.

* * * * *

UNITED STATES PATENT AND TRADEMARK OFFICE

CERTIFICATE OF CORRECTION

PATENT NO. : 4,504,576

DATED : March 12, 1985

INVENTOR(S) : Gregor Kemme

It is certified that error appears in the above-identified patent and that said Letters Patent are hereby corrected as shown below:

Col. 2, Line 37: Change "invention" to --invention,--.
Col. 5, Line 30: Change "brigtener" to --brightener--.
Col. 8, Line 55: Change "gelatin." to --gelatin, and at least one of citric acid or a derivative thereof.--

Signed and Sealed this

*Twenty-seventh* Day of *August 1985*

[SEAL]

*Attest:*

DONALD J. QUIGG

*Attesting Officer*

*Acting Commissioner of Patents and Trademarks*